United States Patent [19]

Wasserman

[11] 3,995,104

[45] Nov. 30, 1976

[54] TRANSPARENT WIRE TAPE AND CONNECTOR

[75] Inventor: Arnold Wasserman, Turnersville, N.J.

[73] Assignee: Hide-A-Wire, Inc., Blackwood, N.J.

[22] Filed: Jan. 20, 1975

[21] Appl. No.: 542,558

Related U.S. Application Data

[63] Continuation-in-part of Ser. No. 432,617, Jan. 11, 1974, abandoned.

[52] U.S. Cl. ..... 174/84 C; 174/117 A; 174/117 F; 339/97 C

[51] Int. Cl.[2] ..... H01R 5/02

[58] Field of Search ... 174/110 N, 120 SR, 110 PM, 174/117 A, 117 F, 84 C; 339/97 C

[56] References Cited

UNITED STATES PATENTS

| | | | |
|---|---|---|---|
| 2,313,234 | 3/1943 | Gauitt | 174/120 SR |
| 2,631,186 | 3/1953 | Bondon | 174/110 N |
| 3,194,877 | 7/1965 | Collier | 339/97 C |
| 3,200,367 | 8/1965 | Blanchenot | 339/97 C |
| 3,703,604 | 11/1972 | Henschen | 339/97 C |
| 3,857,995 | 12/1974 | Wyrick | 174/84 C |

FOREIGN PATENTS OR APPLICATIONS

| | | | |
|---|---|---|---|
| 223,198 | 7/1959 | Australia | 174/110 PM |
| 660,136 | 6/1964 | Italy | 174/117 A |
| 198,739 | 6/1923 | United Kingdom | 174/117 A |

OTHER PUBLICATIONS

Insulation Directory June/July 1970, Lake Publishing, Libertyville, Ill. p. 142.

*Primary Examiner*—E. A. Goldberg
*Attorney, Agent, or Firm*—Charles F. Duffield

[57] ABSTRACT

A wire-tape for completing substantially invisible electrical connections between electrical apparatus over exposed surfaces. The tape includes a clear adhesively coated polypropylene tape to which is adhered a fine wire having an inner coating of polyurethane and an outer coating of nylon. Special electrical terminals and splicing connectors are provided, both of which include a channel into which the wire nests and sharp prongs which pierce the tape and crimp over the wire into electrical contact therewith.

2 Claims, 4 Drawing Figures

Fig. 1
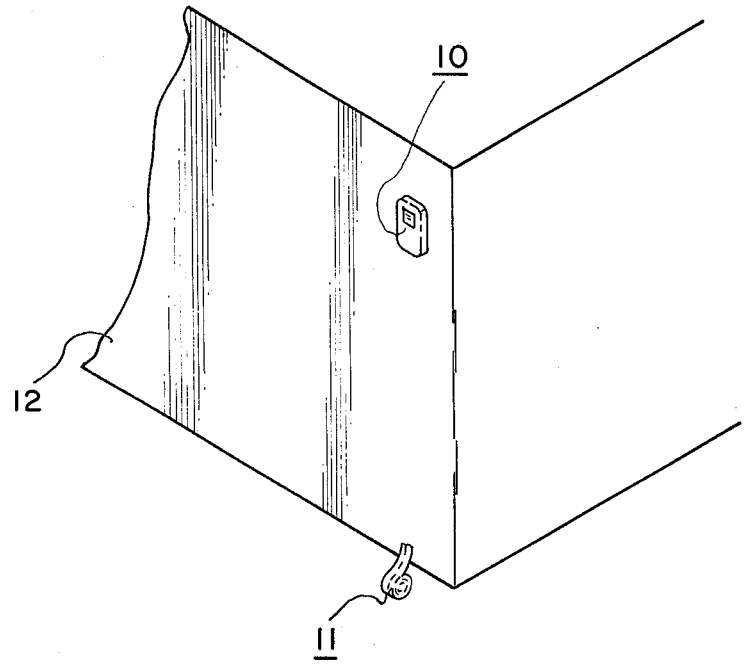
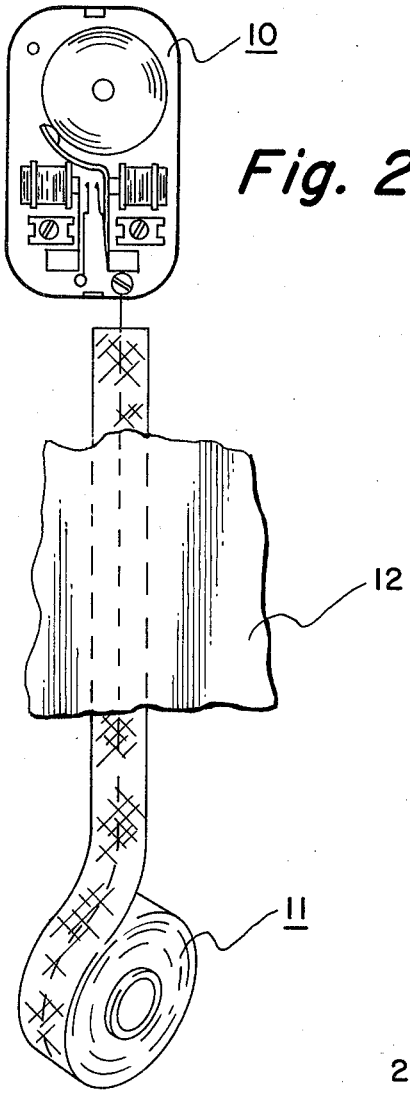
Fig. 2
Fig. 3
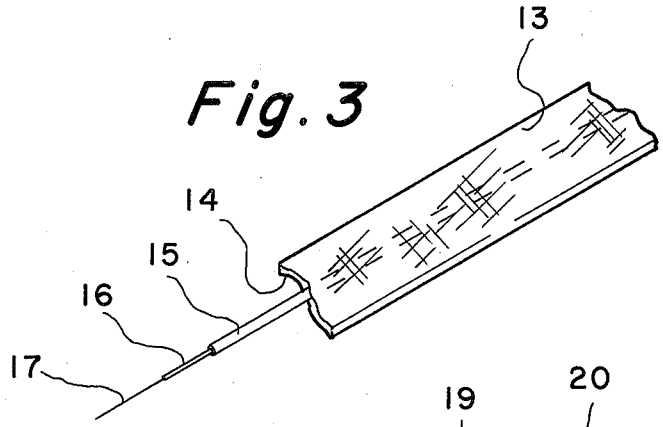
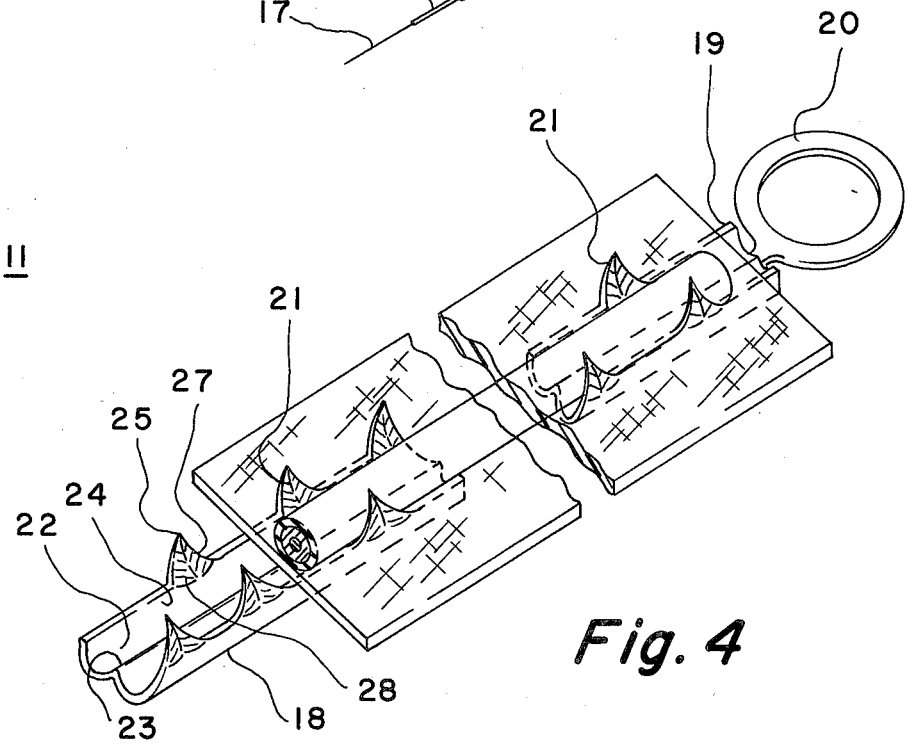
Fig. 4

TRANSPARENT WIRE TAPE AND CONNECTOR

This application is a continuation-in-part of application Ser. No. 432,617 filed Jan. 11, 1974 now abandoned.

BACKGROUND OF INVENTION

The present invention relates to electrical conductors and, more specifically, to fine wire low current-voltage reinforced conductors and terminals and connectors therefor.

There are many electrical devices used in the home and office which require only a low current. Examples of such devices are connections to audio speakers, doorbells, alarm wires and television antenna cables.

The common practice today in installing such devices is to run the wires between the source and the device behind walls of the building, beneath floors and along baseboards. The wires which are used are wires of some substantial size and must be hidden behind the walls, etc. in order to keep them from sight.

The wires which are commonly used with such devices as doorbells, thermostats, etc. are usually of some substantial size and generally a much larger diameter wire than is necessary for the current requirements of the device. The larger wires cannot be readily run across substantially flat and exposed surfaces without creating unsightly conditions due to their size. Smaller wires of sufficient size for the current requirements of the device could be used. However, while the smaller wires would be less unsightly, they usually are secured by some fastening means such as staples and the like which are unsightly. Additionally, the smaller wires, in such an unsupported condition, are fragile and could be easily broken or damaged. Accordingly, the industry has continued to use the larger wires and conceal them out of sight behind walls and the like.

OBJECTS AND SUMMARY OF INVENTION

It is an object of the present invention to overcome the problems of the prior art by providing a wire-type combination which will permit the exposed use of a very fine wire for low current elements while at the same time providing a supporting medium for the wire which is both invisible on the exposed surface and which provides the necessary protection and support for the exposed wire.

It is a further object of the present invention to provide electrical terminals and splicing connectors for use with the wire-tape which can quickly and conveniently be crimped onto the wire on the tape and establish electrical contact through the insulation on the wire without requiring initial removal of the insulation.

The foregoing objects are carried out by the present invention by utilizing a clear thin tape which is adhesively coated on one side. An insulated fine wire is secured to the adhesive side of the tape generally centrally thereof and extends for the length of the tape.

In use, the tape-wire combination may be run between the device to be operated and the current source on essentially flat and exposed surfaces. The adhesive backing on the tape secures the wire in place on the surface while the transparent characteristic of the tape leaves the resultant insulation essentially undetectable on the exposed surface.

The electrical terminals and splicing connectors utilized in conjunction with the wire-tape include a longitudinal channel. The bottom wall of the channel includes an upwardly turned ridge running the length of the channel. The upper side walls of the channel terminate in staggered pointed prongs. The prongs are formed to present a convex face directed inwardly toward the channel. When in use, the prongs of the terminal or connector are projected upwardly through the tape until the wire nests within the channel and the prongs crimped onto the wire breaking the insulation thereon and establishing electrical contact.

Other objects and advantages of the present invention will become apparent to those skilled in the art from the detailed description thereof which follows taken in conjunction with the drawing.

DESCRIPTION OF DRAWING

FIG. 1 illustrates the wire-tape combination of the present invention in place;

FIG. 2 is an expanded view of the installation shown in FIG. 1;

FIG. 3 is a detailed perspective view of the wire-tape combination of the present invention; and FIG. 4 is a perspective view of the splicing connector and electrical terminal of the present invention.

DETAILED DESCRIPTION OF INVENTION

The wire-tape combination of the present invention in position of use is shown in FIGS. 1 and 2. A typical installation for the wire-tape combination would be as a conductor to such a device as a doorbell 10. In this installation, it is not necessary to run wires through the wall 12 but the wire-tape may be run directly from a roll 11 of the tape to the doorbell 10 directly down the wall 12. When the tape is pressed into engagement with the wall, it becomes essentially invisible as indicated in FIGS. 1 and 2 of the drawing. In some installations, it may be preferable to paint over the tape further concealing the tape and securing the tape and included wire in place.

More specifically and as shown in FIG. 3, the wire-tape of the present invention includes a transparent or clear elongate tape 13. The tape is formed, in a particular embodiment, of a polypropylene film of approximately 2.2 mils thickness and ½ inch wide. One side of the tape is coated with suitable adhesive 14.

The wire-tape of the present invention further includes a fine electrically insulted wire which is secured in place by the adhesive midway of the width of the tape and runs for the length of the tape. The insulated wire, in a preferred embodiment, includes a thin inner conductor 17 which is coated with an inner insulation 16 of polyurethane. An outer coating 15 is disposed around the polyurethane coating and is preferably of nylon. The entire package may be rolled into a roll 11 ready for use as shown in FIG. 2.

The electrical terminals and splicing connectors of the present invention are shown in FIG. 4 of the drawing. The splicing connector 18 is identical in construction to the electrical terminal 19 with exception of the addition of the terminal eye 20 utilized on the electrical terminal. Additionally, the number of prongs 21 utilized on the electrical terminal are fewer in number than the number utilized on the splicing connector in a preferred embodiment. Accordingly, a detailed description of the splicing connector 18 only will be made.

The splicing connector 18 includes an elongate channel 22 which extends the length of the connector. The bottom of the channel 22 is formed into an upwardly turned longitudinal ridge 23.

The side walls 24 of the channel 22 have extending from the upper edge thereof a plurality of prongs 21. Each prong 21 terminates in a sharp tip portion 25. Additionally, the prongs are of a convex-concave configuration commencing at their base and extending to the tip 25 of the prong. The face 27 of each prong facing inwardly toward the channel is the convex portion of the concave-convex configuration. Additionally, the face 27 of the prong includes a plurality of rough serrations 28.

In a preferred embodiment of the splicing connector, each side wall of the connector will include three prongs. The prongs are staggered in their opposed relationship one to another as shown in FIG. 2.

In use, the prongs of the connector or terminal are pushed through the tape from the back side thereof opposite the wire until the wire is nested firmly into the channel. Thereafter, the prongs are crimped over onto the wire. The ridge 23 works in conjunction with the concave face of the prongs to break through the insulation on the wire and establish electrical contact.

When the connector is used as a splicing device, each end of the wire-tape to be spliced is positioned midway of the connector as shown in FIG. 2. When the electrical terminal 19 is used, the end of the wire-tape is positioned just outside the eye 20 as shown in FIG. 4.

From the foregoing description, it will be appreciated that the wire-tape combination of the present invention provides a conductor which may be quickly and conveniently run between the electrical device to be powered and the current source over exposed surfaces without creating an unsightly appearance.

Additionally, it will be appreciated that the electrical terminal and splicing connector of the present invention may be quickly and conveniently used in conjunction with the wire-tape of the present invention without the necessity of having to remove the insulation from the wire to establish electrical contact.

The wire-tape, electrical terminal and splicing connector of the present invention have been described in respect to particular embodiments thereof. However, other variations and modifications of the present invention will now become apparent to those skilled in the art. Acccordingly, it is to be understood that no limitaion upon the scope of the invention was intended by the description thereof in respect to the particular embodiments but the scope of the invention is to be interpreted in respect to the appended claims.

I claim:

1. A system providing a transparent low current electrical conductor, supporting medium and electrical interconnecting means comprising:

a longitudinally extending thin, flexible roll of transparent tape;

an adhesive upon a first side of the tape;

a fine insulated electrically conductive wire extending throughout the length of the tape and secured to the first side of the tape generally centrally thereof by the adhesive; and electrical interconnecting means secured to the wire, said interconnecting means including an elongate channel having side walls into which the wire is positioned, an upwardly turned elongate ridge within the channel, and a plurality of sharp prongs extending upwardly from the side walls and terminating in a sharp point and including convex faces thereon further including serrations upon the face projecting through the tape and crimped into engagement with the wire.

2. The system of claim 1 wherein the prongs of the interconnecting means on opposed side walls are in staggered relationship to one another.

* * * * *